United States Patent [19]

Shibata

[11] Patent Number: 4,680,162

[45] Date of Patent: Jul. 14, 1987

[54] METHOD FOR PREPARING AG-SNO SYSTEM ALLOY ELECTRICAL CONTACT MATERIAL

[75] Inventor: Akira Shibata, Yokohama, Japan

[73] Assignee: Chugai Denki Kogyo K.K., Japan

[21] Appl. No.: 834,430

[22] Filed: Feb. 28, 1986

Related U.S. Application Data

[63] Continuation-in-part of Ser. No. 680,667, Dec. 11, 1984, abandoned.

[51] Int. Cl.[4] ..... C21D 1/00

[52] U.S. Cl. ..... 419/21; 75/235; 419/26; 419/29; 419/46; 419/54; 419/55; 419/57; 200/265; 200/266

[58] Field of Search ..... 75/235, 232; 419/21, 419/26, 46, 29; 200/265, 266; 419/54, 55, 57

[56] References Cited

U.S. PATENT DOCUMENTS

| | | | |
|---|---|---|---|
| 2,486,341 | 10/1949 | Stumbock | 419/21 |
| 4,095,977 | 6/1978 | Brugner | 75/234 |
| 4,141,727 | 2/1979 | Shida et al. | 75/234 |
| 4,243,413 | 6/1981 | Shibata | 75/234 |
| 4,315,777 | 2/1982 | Nadkarni et al. | 75/234 |
| 4,341,556 | 7/1982 | Bohm et al. | 75/234 |
| 4,551,301 | 11/1985 | Schreiner | 75/234 |
| 4,609,525 | 9/1986 | Schreiner et al. | 419/21 |

*Primary Examiner*—Stephen J. Lechert, Jr.
*Attorney, Agent, or Firm*—Shlesinger, Fitzsimmons & Shlesinger

[57] ABSTRACT

Ag-SnO system alloy electrical contact materials. The Ag alloy before internal oxidation thereof contains Sn of an amount of 5–20 weight %, 0.5–15 weight % of which amount is in the powder form of $SnO_2$. The existence of $SnO_2$ particles in the alloy accelerates the internal oxidation speed, allowing oxygen to readily pass aside and between the particles, while the internal oxidation per se makes the alloy more dense by eliminating spaces between $SnO_2$ grain particles on account of the volumeric expansion of Sn which results from the internal oxidation thereof.

2 Claims, No Drawings

METHOD FOR PREPARING AG-SNO SYSTEM ALLOY ELECTRICAL CONTACT MATERIAL

CROSS-REFERENCE TO RELATED APPLICATION

This is a continuation-in-part application of U.S. patent application Ser. No. 06/680,667 filed Dec. 11, 1984 now abandoned.

BACKGROUND OF THE INVENTION

Ag alloys, the primary solute metal of which is Sn of a comparatively large amount, such as more than 4.5 weight %, can be completely internal-oxidized in Ag matrices with the help of In and/or Bi. Such Ag-Sn system alloys which contain Sn of more than 4.5 weight % to 10 weight % and In of 0.1–5 weight % and/or Bi of 0.01–5 weight % and which have been internally oxidized, are widely used today as electrical contacts for various electric and electronic appliances. Ag-SnO system alloy electrical contact materials of this kind are disclosed in publications such as U.S. Pat. No. 3,933,485, No. 3,933,486, and No. 4,243,413.

The aforementioned kind of internally oxidized Ag-SnO system alloys are one of the best materials of today for making electrical contact materials having excellent physical and electrical characteristics. However, as they contain a comparatively large amount of Sn, their oxidized solute metals including SnO tend, especially when they have comparatively large dimensions, to segregate too much at outer surface areas, and deplete inner areas, as a result of internal oxidation. Such segregation of oxides within Ag matrices brings about unstableness of electrical and physical characteristics, especially the contact resistances of the materials.

On the other hand, electrical contact materials which are made from powders of Ag and metallic oxides by a powder metallurgical method, can avoid the aforementioned kind of segregation. Nevertheless, those made from powders can hardly compete with those materials which have been alloyed and internally oxidized, because the former are inherently coarse in structure and wear too rapidly even under a normal operating condition.

In view of the above, this invention is to provide a method for preparing internally oxidized Ag-SnO system alloy contact materials having substantially no segregation of metallic oxides therein and having dense structures.

BRIEF SUMMARY OF THE INVENTION

In this invention, Ag-SnO system alloy electrical contact materials are made power-metallurgically by way of mixing powders of Sn of 0.5–10 weight %, $SnO_2$ of 0.5–15 weight %, and Ag being the balance weight %, sintering them to alloys, and internally oxidizing the solute metal elements. When Sn is contained in the sintered alloy at an amount more than 4.5 weight %, In of 0.1–5 weight % and/or Bi of 0.01–5 weight % is inevitably required for successfully internally oxidizing said Sn. Other elements such as Cd, Zn, Sb, Mn, Ca which are solid-soluble with Ag, may be added at an amount less than the total amount of Sn and $SnO_2$, so as to give the resultant internally oxidized alloy materials the specific characteristics or properties desired for their electrical applications. Elements of an iron (ferrous metal) family could be added also to make metallic crystals minute.

The existence of $SnO_2$ grains in the sintered alloys accelerates the speed of internal oxidation, since oxygen can easily pass aside and between the $SnO_2$ grains, and penetrate readily into the alloys, whereby the solute metallic elements in the alloys, particularly Sn, are completely internally oxidized without rich or poor segregation thereof even when the alloys have comparatively large dimensions. In addition to the above advantage, the sintered alloy compacts which are rather coarse as they have been made powder-metallurgically, become dense on account of the internal oxidation which promotes a volumeric expansion of solute elements.

The total amount of Sn and $SnO_2$ in this invention is preferably 5–20 weight %, since less than 5 weight % of them can hardly give the resultant materials refractory characteristics which can withstand arcing, and more than 20 weight % of them make the alloys bulky. And, the employment of less than 0.5 weight % of $SnO_2$ does not enhance the acceleration of internal oxidation, while the employment of more than 15 weight % of it makes the materials bulky again.

EXAMPLES

This invention is further explained in the following examples.

(1)

Sn—5 weight % (of 200 mesh powder)
In—2 weight % (of 200 mesh powder)
$SnO_2$—5 weight % (of 120 mesh powder)
Ag—balance % (of 120 mesh powder)

(2)

Sn—3 weight % (same to the above (1))
$SnO_2$—6 weight % (same to the above (1))
Cd—2 weight % (of 200 mesh powder)
Ag—balance % (same to the above (1))

(3)

Sn—6 weight % (same to the above (1))
$SnO_2$—3 weight % (same to the above (1))
Bi—0.5 weight % (of 200 mesh powder)
Ag—balance % (same to the above (1))

(4)

Sn—4.5 weight % (same to the above (1))
$SnO_2$—6 weight % (same to the above (1))
In—1 weight % (same to the above (1))
Zn—0.5 weight % (of 200 mesh powder)
Ag—balance % (same to the above (1))

(5) Sn—3 weight % (same to the above (1))
$SnO_2$—5 weight % (same to the above (1))
Bi—0.5 weight % (same to the above (1))
Sb—0.5 weight % (of 200 mesh powder)
Ag—balance % (same to the above (1))

The above constituents (1) to (5) were respectively mixed in a vibration mill for 48 hours. These mixtures (1) to (5) were each pressed under 50 T/cm$^2$ to form compacts of 50 mm width, 100 mm length, and 10 mm height, with pure Ag backs. Each compact was sintered for 2 hours in an argon gas at 800° C., and then hot-rolled at 850°–900° C. to a thickness of 2 mm. The compacts were then internally oxidized in an oxygen atmosphere of 10 atm. at 700° C. for 2.5 hours.

The resultant Ag-SnO system alloy electrical contact materials (1) to (5) had the following properties, showing that they are good for use in breakers, contactors, relays, and switches, while it has been confirmed by microscopic observations that they had substantially no segregation of metallic oxides within Ag matrices.

| | | Conductivity (IACS %) | Hardness (HR "F") |
|---|---|---|---|
| Material | (1) | 48–52 | 92–98 |
| | (2) | 52–56 | 88–92 |
| | (3) | 48–53 | 102–105 |
| | (4) | 51–54 | 100–106 |
| | (5) | 55–59 | 97–99 |

While time and temperature of sintering in this method are subject to variation, sintering the pressed mixtures shall be at a temperature between 700° C. and 900° C. for 1 to 5 hours, as known to the skilled in this art, for example as indicated in U.S. Pat. No. 4,141,727.

And, the argon gas used in the above examples can be replaced by other inert gases.

I claim:

1. A method of making electrical contact materials, comprising mixing powders of Sn, SnO and Ag in the weight percentages of 0.5–10% Sn, 0.5–15% SnO and the balance being Ag when the weight % of Sn is less than 4.5, said balance being Ag and at least one of In in the range of 0.1–5 weight % and Bi in the range of 0.01–5 weight %, when the weight % of Sn is greater than 4.5, forming said mixture into a powdered-metallurgically prepared alloy compact, and treating said alloy compact to effect complete internal oxidizing thereof.

2. The method as claimed in claim 1, in which the mixture further contains an element or elements of less than the amount of said tin and tin oxides and selected from the group consisting of Cd, Zn, Sb, Mn and Ca.

* * * * *